US011391238B2

(12) United States Patent
Schulz et al.

(10) Patent No.: US 11,391,238 B2
(45) Date of Patent: Jul. 19, 2022

(54) PROCESS FOR PRODUCING AN ENGINE COMPONENT, ENGINE COMPONENT AND THE USE OF AN ALUMINUM ALLOY

(71) Applicant: Mahle International GmbH, Stuttgart (DE)

(72) Inventors: Joachim Schulz, Stuttgart (DE); Andreas S. Nie, Winterbach (DE); Christian Selzner, Bietigheim-Bissingen (DE)

(73) Assignee: Mahel International GmbH

( * ) Notice: Subject to any disclaimer, the term of this patent is extended or adjusted under 35 U.S.C. 154(b) by 115 days.

(21) Appl. No.: 16/875,895

(22) Filed: May 15, 2020

(65) Prior Publication Data

US 2020/0362792 A1 Nov. 19, 2020

(30) Foreign Application Priority Data

May 16, 2019 (DE) ..... 102019207188.0
Apr. 23, 2020 (DE) ..... 102020205193.3

(51) Int. Cl.
*F02F 3/00* (2006.01)
*C22C 21/02* (2006.01)
*B22D 21/00* (2006.01)

(52) U.S. Cl.
CPC ..... *F02F 3/0084* (2013.01); *B22D 21/007* (2013.01); *C22C 21/02* (2013.01)

(58) Field of Classification Search
CPC ..... F02F 3/0084; F02F 3/00; F02F 2007/009; B22D 21/007; B22D 21/04; C22C 21/02; C22C 21/04
See application file for complete search history.

(56) References Cited

U.S. PATENT DOCUMENTS

| | | | |
|---|---|---|---|
| 5,055,255 A | 10/1991 | Scott et al. | |
| 10,022,788 B2 | 7/2018 | Morgenstern et al. | |
| 10,189,080 B2 | 1/2019 | Morgenstern et al. | |

FOREIGN PATENT DOCUMENTS

| | | | | |
|---|---|---|---|---|
| CN | 104812921 A * | 7/2015 | ..... | B22D 23/00 |
| CN | 104812921 A | 7/2015 | | |
| DE | 44 04 420 A1 | 8/1995 | | |
| DE | 4404420 C2 * | 7/1997 | ..... | C22C 21/02 |
| DE | 103 33 103 A1 | 2/2004 | | |
| DE | 10 2011 083 969 A1 | 4/2013 | | |
| EP | 0 924 310 A1 | 6/1999 | | |
| EP | 0 924 311 A1 | 6/1999 | | |
| EP | 2 920 334 A1 | 9/2015 | | |
| JP | 2000-204428 A | 7/2000 | | |
| JP | 2004-256873 A | 9/2004 | | |
| WO | 2006/056686 | 6/2006 | | |
| WO | 2015/173172 | 11/2015 | | |

OTHER PUBLICATIONS

Zhou, Barium, ein Dauerveredelungsmittel fur eutekische Aluminum-Silicum-Legierungen, 1983, GieBerei-Praxis, Table 3 (Year: 1983).*
Chinese Office Action dated May 26, 2021 related to corresponding Chinese Patent Application No. 202010414991.3.
Cast Nonferrous: Aluminum Alloys—Effects of Alloying Elements. Key to Metals. Sep. 2002. http://www.keytometals.com/fluxana/page.aspx?ID=CheckArticle&site=ktn&NM=55.
Zhou et al., Barium, Dauerveredelungsmittel fur eutektische Aluminium-Silicium-Legierungen. Giefsserei-Praxis.1983. pp. 49-52.
German Search Report dated Nov. 16, 2020 related to corresponding German Patent Application No. 102020205193.3.
English abstract for DE-44 04 420.
English abstract for DE-10 2011 083 969.
English abstract for JP-2004-256873.
English abstract for JP-2000-204428.
Chinese Office Action dated Oct. 21, 2021 related to corresponding Chinese Patent Application No. 202010414991.3.
Al—Si—Cu—Ni—Mg Sep. 30, 2017.
Chinese Office Action dated Apr. 21, 2022 for Chinese Patent Application No. 202010414991.3.

* cited by examiner

*Primary Examiner* — Jacob M Amick
*Assistant Examiner* — Charles J Brauch
(74) *Attorney, Agent, or Firm* — Fishman Stewart PLLC

(57) ABSTRACT

The present disclosure describes a process for producing an engine component, e.g., a piston for an internal combustion engine, where an aluminum alloy is cast by gravity diecasting, and an engine component composed at least partly of an aluminum alloy. The aluminum alloy includes silicon 8% to 17% by wt., copper 2% to 10% by wt., nickel 1% to 6% by wt., iron 0.1% to 3.5% by wt., magnesium 0.1% to 2% by wt., manganese 0.1% to 4% by wt., barium up to 4% by wt., titanium up to 0.5% by wt., zirconium up to 0.4% by wt., vanadium up to 0.3% by wt., phosphorus up to 0.05% by wt., chromium up to 0.3% by wt., and a balance of aluminum and unavoidable impurities.

20 Claims, No Drawings

PROCESS FOR PRODUCING AN ENGINE COMPONENT, ENGINE COMPONENT AND THE USE OF AN ALUMINUM ALLOY

CROSS-REFERENCE TO RELATED APPLICATIONS

This application claims priority to German Application No. DE 10 2020 205 193.3 filed on Apr. 23, 2020, and to German Patent Application No. DE 10 2019 207 188.0 filed on May 16, 2019, the contents of each of which is hereby incorporated by reference in their entirety.

TECHNICAL FIELD

The present invention relates to a process for producing an engine component, especially a piston for an internal combustion engine, in which an aluminum alloy is cast by the gravity diecasting method. The invention further relates to an engine component consisting at least partly of an aluminum alloy, and to the use of this alloy for production of an engine component.

BACKGROUND

In the automotive industry and other branches of industry concerned mainly with the internal combustion engine, there is a need to maximize performance and efficiency and minimize wear in the engines. An important factor in engine development is the piston. The intention is to use pistons at ever higher combustion pressures and combustion temperatures. One way of achieving this is by means of more efficient and higher-performance materials.

It is essential that a piston alloy in the internal combustion engine has high thermal stability with simultaneous strength and low weight. Owing to the demand for low weight, the alloys considered are mainly aluminum alloys. Since aluminum has a low melting point and also low strengths, the microstructure morphology, chemical composition and formation of phases of high thermal stability play a major role. It is of course also necessary to take account of oxidic defects and pores and keep them as small as possible, since such defects and pores adversely affect the lifetime of the piston.

A suitable material has to be optimized both with regard to thermomechanical fatigue resistance (TFR) and with regard to high-cycle dynamic strength (HCDS). In order to optimize TFR, the aim must always be a very fine microstructure of the material. A fine microstructure reduces the risk of formation of microplasticity and of microcracks in relatively large phases (primary silicon precipitates and other intermetallic precipitates) and hence also reduces the risk of crack initiation and of crack propagation. Under TFR stress, microplasticity or microcracks occur in relatively large primary phases, especially in primary silicon precipitates, and these can considerably shorten the lifetime of the piston material. With regard to increasing the lifetime, it is known that these primary phases should be minimized.

In gravity diecasting, which is used for production of a piston, there is an upper concentration limit up to which alloy elements can be introduced, the exceedance of which reduces the castability of the alloy or makes casting impossible. Furthermore, at excessively high concentrations of strength-increasing elements, for example nickel and iron, there is formation of large intermetallic phases in platelet form that drastically lower fatigue resistance.

EP 0 924 310 B1 describes an aluminum-silicon alloy employed in the production of pistons, especially pistons in internal combustion engines. The aluminum-silicon alloy has the following composition: 10.5% to 13.5% by wt. of silicon, 2.0% to less than 4.0% by wt. of copper, 0.8% to 1.5% by wt. of magnesium, 0.5% to 2.0% by wt. of nickel, 0.3% to 0.9% by wt. of cobalt, at least 20 ppm by weight of phosphorus and either 0.005% to 0.2% by wt. of titanium or up to 0.2% by wt. of zirconium and/or up to 0.2% by wt. of vanadium and, as the balance, aluminum and unavoidable impurities.

EP 2 920 334 B1 describes a process for producing an engine component using an aluminum-silicon alloy. This alloy has the following composition: 9% to 10.5% by wt. of silicon, 3.7% to 5.2% by wt. of copper, 0.5% to 1.5% by wt. of magnesium, 2% to 3.5% by wt. of nickel, 0% to less than 1% by wt. of cobalt, 0.1% to 0.7% by wt. of iron, 0.1% to 0.4% by wt. of manganese, more than 0.1% to less than 0.2% by wt. of zirconium, more than 0.1% to less than 0.2% by wt. of titanium, 40 to 80 ppm by weight of phosphorus and, as the balance, aluminum and unavoidable impurities.

WO 2015/173172 A1 relates to a process for producing an engine component using an aluminum-silicon alloy. This alloy has the following composition: 7% to 14.5% by wt. of silicon, more than 3.7% to less than 10% by wt. of copper, 0.1% to 1.5% by wt. of magnesium, more than 1.2% to 4% by wt. of nickel, less than 1% by wt. of cobalt, 0.1% to 0.7% by wt. of iron, 0.1% to 0.7% by wt. of manganese, more than 0.1% to less than 0.5% by wt. of zirconium, 0.05% to 0.5% by wt. of titanium, 0.004% to 0.05% by wt. of phosphorus and, as the balance, aluminum and unavoidable impurities.

DE 44 04 420 C2 describes an alloy that can be used especially for pistons and for components that are subject to high mechanical stress and high temperatures. The aluminum alloy described comprises: 8% to 10.9% by wt. of silicon, 4.0% to 5.9% by wt. of copper, 0.8% to 2% by wt. of magnesium, 1.0% to 3.0% by wt. of nickel, less than 0.5% by wt. of iron, 0.2% to 0.4% by wt. of manganese, and at least one element from the group of antimony, zirconium, titanium, strontium, cobalt, chromium, vanadium, where at least one of these elements is present in an amount of more than 0.3% by wt., and where the sum total of these elements is less than 0.8% by wt., and, as the balance, aluminum and unavoidable impurities.

DE 103 33 103 A1 describes a piston manufactured from an aluminum alloy containing 0.05% to 0.3% by wt. of titanium, 10% to 21% by wt. of silicon, 2% to 3.5% by wt. of copper, 0.1% to 0.7% by wt. of iron, 1% to 3% by wt. of nickel, 0.001% to 0.02% by wt. of phosphorus and, as the balance, aluminum and unavoidable impurities.

EP 0 924 311 A1 describes an aluminum-silicon alloy for the manufacture of pistons, containing 10.5% to 13.5% by wt. of silicon, 2.0% to 4.0% by wt. of copper, 0.5% to 2.0% by wt. of nickel, 0.8% to 1.5% by wt. of magnesium, 0.2% to 0.6% by wt. of silver, 0.2% to 0.6% by wt. of cobalt, at least 20 ppm by weight of phosphorus and, as the balance, aluminum and unavoidable impurities. Cobalt serves as substitute for nickel and forms intermetallic phases of high thermal stability. Silver enhances fatigue strength in the moderate temperature range.

DE 10 2011 083 969 relates to a process for producing a piston in which an aluminum-silicon alloy having the following alloy constituents is used: 6% to 10% by wt. of silicon, 1.2% to 2% by wt. of nickel, 8% to 10% by wt. of copper, 0.5% to 1.5% by wt. of magnesium, 0.1% to 0.7% by wt. of iron, 0.1% to 0.4% by wt. of manganese, 0.2% to 0.4% by wt. of zirconium, 0.1% to 0.3% by wt. of vanadium, 0.1% to 0.5% by wt. of titanium, 40 to 80 ppm by weight of phosphorus and, as the balance, aluminum and unavoidable impurities.

U.S. Pat. No. 5,055,255 A describes an aluminum-silicon alloy suitable for the manufacture of pistons, having the following alloy constituents: at least 9% by wt. of silicon, 3% to 7% by wt. of nickel, 1.5% to 6% by wt. of copper, and at least one element from the group of magnesium, manganese, vanadium, scandium, iron, titanium, strontium, zirconium, boron and chromium, and, as the balance, aluminum and unavoidable impurities.

SUMMARY

It is an object of the present invention to provide a process for producing an engine component, especially a piston for an internal combustion engine, in which an aluminum alloy is cast by the gravity diecasting method, such that an engine component of high thermal stability can be manufactured by the gravity diecasting method.

This object is achieved by the process according to the claim(s). Further preferred embodiments of the invention are apparent from the respective dependent claims.

DETAILED DESCRIPTION

The invention provides a process for producing an engine component, especially a piston for an internal combustion engine, in which an aluminum alloy is cast by the gravity diecasting method, wherein the aluminum alloy consists of the alloy elements silicon 8% to 17% by wt.,
copper 2% to 10% by wt.,
nickel 1% to 6% by wt.,
iron 0.1% to 3.5% by wt.,
magnesium 0.1% to 2% by wt.,
manganese 0.1% to 4% by wt.,
barium up to 4% by wt.,
titanium up to 0.5% by wt.,
zirconium up to 0.4% by wt.,
vanadium up to 0.3% by wt.,
phosphorus up to 0.05% by wt.,
chromium up to 0.3% by wt.,
and, as the balance, aluminum and unavoidable impurities.

Particularly in the case of relatively high Si contents, large primary Si precipitates are formed, which have a crack-promoting effect under HCDS/TFR stress. The proportion of phosphorus acts as a nucleating agent for primary silicon precipitates, which are finely and uniformly distributed. As a result, even with the relatively high silicon content claimed, fine phases are formed, which counteract crack initiation and crack growth under HCDS/TFR stress. The proportions of copper, nickel, iron, and of titanium, zirconium and vanadium, result in strength-increasing precipitates of high thermal stability. The iron reduces the tendency to stick to the casting die. Higher proportions of copper improve thermal stability, while a lower proportion improves thermal conductivity and reduces the density of the alloy. The proportion of magnesium leads to formation of secondary, matrix-hardening phases. With chromium as additional element, phases of high thermal stability are obtained, which form at temperatures around 200° C.

In a preferred embodiment, barium may be added, which suppresses the formation of primary coarse silicon phases, such that finely dispersed silicon phases are present to an increased degree, which firstly prevent the notch effect of coarse silicon phases and secondly increase the proportion of phases of highest thermal stability. The application-optimized selection of the barium-silicon ratio in the alloy of the invention thus allows adjustment of silicon contents within a wide range without increased formation of coarse primary silicon precipitates. This reduces crack initiation and crack propagation under TFR/HCDS stress and increases the lifetime of the component manufactured therefrom.

In a preferred embodiment, the aluminum alloy consists of the alloy elements silicon 8% to 13% by wt.,
copper 3% to 6% by wt.,
nickel 2% to 6% by wt.,
iron 0.7% to 2% by wt.,
magnesium 0.2% to 1% by wt.,
manganese 0.7% to 2.5% by wt.,
barium up to 4% by wt.,
titanium up to 0.3% by wt.,
zirconium up to 0.3% by wt.,
vanadium up to 0.2% by wt.,
phosphorus 0.004% to 0.05% by wt.,
chromium up to 0.3% by wt.
and, as the balance, aluminum and unavoidable impurities.

Iron-nickel phases as in this preferred embodiment are one of the phases of highest thermal stability. The problem is that, over and above an iron content of 0.5% by wt. and over and above a nickel content of greater than 2.5% by wt., coarse Ni—Fe—Si phases in platelet form can form. The addition of manganese in the amounts claimed here can result in morphological conversion of these phases, even in the case of a relatively high iron content, in such a way that these act less critically as starting points for cracks. It is therefore also possible to increase the Ni—Fe-containing phase component without resulting in the formation of the phases in platelet form. This brings the advantage that it is possible to use higher nickel and iron contents in this embodiment, which form a more thermally stable primary phase network, with higher connectivity. The result is thus higher strength at high temperatures of 300 to 400° C.

In a further preferred embodiment, the aluminum alloy consists of the alloy elements silicon 8% to 15% by wt.,
copper 3% to 10% by wt.,
nickel 1.5% to 5% by wt.,
iron 0.7% to 2% by wt.,
magnesium 0.2% to 1% by wt.,
manganese 0.7% to 2.5% by wt.,
barium up to 4% by wt.,
titanium 0.03% to 0.3% by wt.,
zirconium 0.03% to 0.3% by wt.,
vanadium up to 0.2% by wt.,
phosphorus 0.004% to 0.05% by wt.,
chromium up to 0.2% by wt.,
and, as the balance, aluminum and unavoidable impurities.

Copper-nickel phases as in this preferred embodiment are likewise notable for high thermal stability and can additionally be introduced into the microstructure in appreciable amounts. The addition of higher proportions of nickel and copper to the alloy can increase the proportion of phases of high thermal stability. In order to obtain a ratio advantageous for the application of iron-nickel and copper-nickel phases, and to distinctly reduce the known microporosity at high copper contents, therefore, preference is given to an embodiment having a ratio of copper:nickel of 1.25:1 to 2.5. With chromium as an additional element—as already mentioned—phases of high thermal stability are obtained, which form in a finely dispersed manner in the moderate temperature range.

In a further preferred embodiment, the aluminum alloy consists of the alloy elements
silicon 11% to 13% by wt.,
copper 4% to 7% by wt.,
nickel 1% to 3% by wt.,
iron 0.15% to 1% by wt.,
magnesium 0.2% to 1% by wt.,
manganese ≥0.1% by wt.,
barium up to 1% by wt.,
titanium 0.03% to 0.3% by wt.,
zirconium 0.03% to 0.3% by wt.,
vanadium up to 0.2% by wt.,
phosphorus 0.004% to 0.05% by wt.,
chromium up to 0.2% by wt.,
and, as the balance, aluminum and unavoidable impurities.

The reduction in the elements iron and nickel with a simultaneously elevated copper content and a silicon content in the region of the eutectic point leads to preferred precipitation and arrangement of the intermetallic phases within the base microstructure of the piston alloy, as a result of which the physical properties of density and thermal conductivity that are important for piston alloys are positively influenced without reducing the required strengths of the piston material.

Preference is also given to an aluminum alloy composed of the alloy elements
silicon 10% to 15% by wt.,
copper 5.2% to 9% by wt.,
nickel 1.5% to 4% by wt.,
iron 0.2% to 1.5% by wt.,
magnesium 0.2% to 1% by wt.,
manganese 0.2% to 1.5% by wt.,
barium up to 4% by wt.,
titanium 0.03% to 0.3% by wt.,
zirconium 0.03% to 0.3% by wt.,
vanadium up to 0.2% by wt.,
phosphorus 0.004% to 0.05% by wt.,
chromium up to 0.2% by wt.,
and, as the balance, aluminum and unavoidable impurities.

Particular preference is given to an aluminum alloy composed of the alloy elements
silicon 11% to 14% by wt.,
copper 5.2% to 8% by wt.,
nickel 2% to 4% by wt.,
iron 0.2% to 1.5% by wt.,
magnesium 0.2% to 1% by wt.,
manganese 0.2% to 1.3% by wt.,
barium up to 1% by wt.,
titanium 0.05% to 0.2% by wt.,
zirconium 0.05% to 0.2% by wt.
vanadium up to 0.2% by wt.,
phosphorus 0.004% to 0.05% by wt.
chromium up to 0.2% by wt.,
and, as the balance, aluminum and unavoidable impurities.

An engine component of the invention consists at least partly of one of the abovementioned aluminum alloys. A further independent aspect of the invention lies in the use of the abovementioned aluminum alloys for the production of an engine component, especially a piston of an internal combustion engine. More particularly, the aluminum alloy is processed here by the gravity diecasting method.

It will be apparent that the aforementioned features are usable not just in the combination specified in each case but also in other combinations or on their own without leaving the scope of the present invention.

EXAMPLES

Example 1 silicon 14% to 17% by wt.,
copper 3% to 5% by wt.,
nickel 2% to 4% by wt.,
iron 0.8% to 1.5% by wt.,
magnesium 0.5% to 1% by wt.,
manganese 1% to 2% by wt.,
barium up to 2.5% by wt.,
titanium 0.03% to 0.3% by wt.,
zirconium 0.03% to 0.3% by wt.
vanadium 0.03% to 0.2% by wt.,
phosphorus 0.004% to 0.05% by wt.
chromium up to 0.2% by wt.

Example 2 silicon 9% to 12% by wt.,
copper 3% to 5% by wt.,
nickel 2.5% to 4% by wt.,
iron 0.8% to 2% by wt.,
magnesium 0.4% to 1% by wt.,
manganese 0.8% to 2.3% by wt.,
barium up to 1% by wt.,
titanium 0.03% to 0.3% by wt.,
zirconium 0.03% to 0.3% by wt.
vanadium up to 0.2% by wt.,
phosphorus 0.004% to 0.05% by wt.
chromium up to 0.2% by wt.

Example 3 silicon 11% to 13% by wt.,
copper 5.5% to 8% by wt.,
nickel 2% to 4% by wt.,
iron 0.3% to 1.2% by wt.,
magnesium 0.2% to 1% by wt.,
manganese 0.3% to 1.2% by wt.,
barium up to 1% by wt.,
titanium 0.03% to 0.3% by wt.,
zirconium 0.03% to 0.3% by wt.
vanadium up to 0.2% by wt.,
phosphorus 0.004% to 0.05% by wt.
chromium up to 0.2% by wt.

Example 4 silicon 11% to 13% by wt.,
copper 4% to 7% by wt.,
nickel 1% to 3% by wt.,
iron 0.15% to 1% by wt.,
magnesium 0.2% to 1% by wt.,
manganese ≥0.1% by wt.,
barium up to 1% by wt.,
titanium 0.03% to 0.3% by wt.,
zirconium 0.03% to 0.3% by wt.,
vanadium up to 0.2% by wt.,
phosphorus 0.004% to 0.05% by wt.,
chromium up to 0.2% by wt.,
and, as the balance, aluminum and unavoidable impurities.

The invention claimed is:

1. A process for producing an engine component, comprising:

casting an aluminum alloy in a gravity diecasting method, wherein the aluminum alloy contains the following alloy elements:

silicon 11% to 14% by wt.,
copper 2% to 10% by wt.,
nickel 1% to 6% by wt.,
iron 0.1% to 3.5% by wt.,
magnesium 0.1% to 2% by wt.,
manganese 0.1% to 4% by wt.,
barium up to 4% by wt.,
titanium up to 0.5% by wt.,
zirconium up to 0.4% by wt.,
vanadium up to 0.3% by wt.,
phosphorus up to 0.05% by wt.,
chromium up to 0.3% by wt., and
a balance of aluminum and unavoidable impurities.

2. The process according to claim 1, wherein the aluminum alloy consists of the alloy elements:

silicon 11% to 13% by wt.,
copper 3% to 6% by wt.,
nickel 2% to 6% by wt.,
iron 0.7% to 2% by wt.,
magnesium 0.2% to 1% by wt.,
manganese 0.7% to 2.5% by wt.,
barium up to 4% by wt.,
titanium up to 0.3% by wt.,
zirconium up to 0.3% by wt.,
vanadium up to 0.2% by wt.,
phosphorus 0.004% to 0.05% by wt., and
the balance being aluminum and unavoidable impurities.

3. The process according to claim 1, wherein the aluminum alloy consists of the alloy elements:

silicon 11% to 14% by wt.,
copper 3% to 10% by wt.,
nickel 1.5% to 5% by wt.,
iron 0.7% to 2% by wt.,
magnesium 0.2% to 1% by wt.,
manganese 0.7% to 2.5% by wt.,
barium 0% to 4% by wt.,
titanium 0.03% to 0.3% by wt.,
zirconium 0.03% to 0.3% by wt.,
vanadium up to 0.2% by wt.,
phosphorus 0.004% to 0.05% by wt.,
chromium up to 0.2% by wt., and
the balance being aluminum and unavoidable impurities.

4. The process according to claim 1, wherein the aluminum alloy consists of the alloy elements:

silicon 11% to 13% by wt.,
copper 4% to 7% by wt.,
nickel 1% to 3% by wt.,
iron 0.15% to 1% by wt.,
magnesium 0.2% to 1% by wt.,
manganese ≥0.1% by wt.,
barium up to 1% by wt.,
titanium 0.03% to 0.3% by wt.,
zirconium 0.03% to 0.3% by wt.,
vanadium up to 0.2% by wt.,
phosphorus 0.004% to 0.05% by wt.,
chromium up to 0.2% by wt., and
the balance being aluminum and unavoidable impurities.

5. The process according to claim 1, wherein the aluminum alloy consists of the alloy elements:

silicon 11% to 14% by wt.,
copper 5.2% to 9% by wt.,
nickel 1.5% to 4% by wt.,
iron 0.2% to 1.5% by wt.,
magnesium 0.2% to 1% by wt.,
manganese 0.2% to 1.5% by wt.,
barium up to 4% by wt.,
titanium up to 0.3% by wt.,
zirconium up to 0.3% by wt.,
vanadium up to 0.3% by wt.,
phosphorus 0.004% to 0.05% by wt.,
chromium up to 0.2% by wt., and
the balance being aluminum and unavoidable impurities.

6. The process according to claim 5, wherein the aluminum alloy consists of the alloy elements:

silicon 11% to 14% by wt.,
copper 5.2% to 8% by wt.,
nickel 1.5% to 4% by wt.,
iron 0.2% to 1.5% by wt.,
magnesium 0.2% to 1% by wt.,
manganese 0.2% to 1.3% by wt.,
barium up to 1%
titanium 0.05% to 0.2% by wt.,
zirconium 0.05% to 0.2% by wt.,
vanadium up to 0.2% by wt.,
phosphorus 0.004% to 0.05% by wt., and
the balance being aluminum and unavoidable impurities.

7. An engine component, comprising: an aluminum alloy, wherein the aluminum alloy contains the following alloy elements:

silicon 11% to 14% by wt.,
copper 2% to 10% by wt.,
nickel 1% to 6% by wt.,
iron 0.1% to 3.5% by wt.,
magnesium 0.1% to 2% by wt.,
manganese 0.1% to 4% by wt.,
barium up to 4% by wt.,
titanium up to 0.5% by wt.,
zirconium up to 0.4% by wt.,
vanadium up to 0.3% by wt.,
phosphorus up to 0.05% by wt.,
chromium up to 0.3% by wt., and
a balance of aluminum and unavoidable impurities.

8. An aluminum alloy for an engine component, comprising a composition including the following alloy elements:

silicon 8% to 17% by wt.,
copper 2% to 10% by wt.,
nickel 1% to 6% by wt.,
iron 0.1% to 3.5% by wt.,
magnesium 0.1% to 3% by wt.,
manganese 0.7% to 2.5% by wt.,
barium up to 4% by wt.,
titanium up to 0.5% by wt.,
zirconium up to 0.4% by wt.,
vanadium up to 0.3% by wt.,
phosphorus up to 0.05% by wt.,
chromium up to 0.3% by wt., and
a balance of aluminum and unavoidable impurities.

9. The aluminum alloy according to claim 8, wherein the composition consists of the alloy elements:

silicon 8% to 13% by wt.,
copper 3% to 6% by wt.,
nickel 2% to 6% by wt.,
iron 0.7% to 2% by wt.,
magnesium 0.2% to 1% by wt.,
manganese 0.7% to 2.5% by wt.,
barium up to 4% by wt.,
titanium up to 0.3% by wt.,
zirconium up to 0.3% by wt., vanadium up to 0.2% by wt.,
phosphorus 0.004% to 0.05% by wt., and
the balance being aluminum and unavoidable impurities.

10. The aluminum alloy according to claim 8, wherein the composition consists of the alloy elements:
silicon 8% to 15% by wt.,
copper 3% to 10% by wt.,
nickel 1.5% to 5% by wt.,
iron 0.7% to 2% by wt.,
magnesium 0.2% to 1% by wt.,
manganese 0.7% to 2.5% by wt.,
barium 0% to 4% by wt.,
titanium 0.03% to 0.3% by wt.,
zirconium 0.03% to 0.3% by wt.,
vanadium up to 0.2% by wt.,
phosphorus 0.004% to 0.05% by wt.,
chromium up to 0.2% by wt., and
the balance being aluminum and unavoidable impurities.

11. The aluminum alloy according to claim 8, wherein the composition consists of the alloy elements:
silicon 11% to 13% by wt.,
copper 4% to 7% by wt.,
nickel 1% to 3% by wt.,
iron 0.15% to 1% by wt.,
magnesium 0.2% to 1% by wt.,
manganese 0.7% to 2.5% by wt.,
barium up to 1% by wt.,
titanium 0.03% to 0.3% by wt.,
zirconium 0.03% to 0.3% by wt.,
vanadium up to 0.2% by wt.,
phosphorus 0.004% to 0.05% by wt.,
chromium up to 0.2% by wt., and
the balance being aluminum and unavoidable impurities.

12. The aluminum alloy according to claim 8, wherein the composition consists of the alloy elements:
silicon 10% to 15% by wt.,
copper 5.2% to 9% by wt.,
nickel 1.5% to 4% by wt.,
iron 0.2% to 1.5% by wt.,
magnesium 0.2% to 1% by wt.,
manganese 0.7% to 2.5% by wt.,
barium up to 4% by wt.,
titanium up to 0.3% by wt.,
zirconium up to 0.3% by wt.,
vanadium up to 0.3% by wt.,
phosphorus 0.004% to 0.05% by wt.,
chromium up to 0.2% by wt., and
the balance being aluminum and unavoidable impurities.

13. The aluminum alloy according to claim 12, wherein the composition consists of the alloy elements:
silicon 11% to 14% by wt.,
copper 5.2% to 8% by wt.,
nickel 1.5% to 4% by wt.,
iron 0.2% to 1.5% by wt.,
magnesium 0.2% to 1% by wt.,
manganese 0.7% to 2.5% by wt.,
barium up to 1%
titanium 0.05% to 0.2% by wt.,
zirconium 0.05% to 0.2% by wt.,
vanadium up to 0.2% by wt.,
phosphorus 0.004% to 0.05% by wt., and
the balance being aluminum and unavoidable impurities.

14. The engine component according to claim 7, wherein the aluminum alloy consists of the alloy elements:
silicon 11% to 13% by wt.,
copper 3% to 6% by wt.,
nickel 2% to 6% by wt.,
iron 0.7% to 2% by wt.,
magnesium 0.2% to 1% by wt.,
manganese 0.7% to 2.5% by wt.,
barium up to 4% by wt.,
titanium up to 0.3% by wt.,
zirconium up to 0.3% by wt.,
vanadium up to 0.2% by wt.,
phosphorus 0.004% to 0.05% by wt., and
the balance being aluminum and unavoidable impurities.

15. The engine component according to claim 7, wherein the aluminum alloy consists of the alloy elements:
silicon 11% to 14% by wt.,
copper 3% to 10% by wt.,
nickel 1.5% to 5% by wt.,
iron 0.7% to 2% by wt.,
magnesium 0.2% to 1% by wt.,
manganese 0.7% to 2.5% by wt.,
barium 0% to 4% by wt.,
titanium 0.03% to 0.3% by wt.,
zirconium 0.03% to 0.3% by wt.,
vanadium up to 0.2% by wt.,
phosphorus 0.004% to 0.05% by wt.,
chromium up to 0.2% by wt., and
the balance being aluminum and unavoidable impurities.

16. The engine component according to claim 7, wherein the aluminum alloy consists of the alloy elements:
silicon 11% to 13% by wt.,
copper 4% to 7% by wt.,
nickel 1% to 3% by wt.,
iron 0.15% to 1% by wt.,
magnesium 0.2% to 1% by wt.,
manganese ≥0.1% by wt.,
barium up to 1% by wt.,
titanium 0.03% to 0.3% by wt.,
zirconium 0.03% to 0.3% by wt.,
vanadium up to 0.2% by wt.,
phosphorus 0.004% to 0.05% by wt.,
chromium up to 0.2% by wt., and
the balance being aluminum and unavoidable impurities.

17. The engine component according to claim 7, wherein the aluminum alloy consists of the alloy elements:
silicon 11% to 14% by wt.,
copper 5.2% to 9% by wt.,
nickel 1.5% to 4% by wt.,
iron 0.2% to 1.5% by wt.,
magnesium 0.2% to 1% by wt.,
manganese 0.2% to 1.5% by wt.,
barium up to 4% by wt.,
titanium up to 0.3% by wt.,
zirconium up to 0.3% by wt.,
vanadium up to 0.3% by wt.,
phosphorus 0.004% to 0.05% by wt.,
chromium up to 0.2% by wt., and
the balance being aluminum and unavoidable impurities.

18. The engine component according to claim 17, wherein the aluminum alloy consists of the alloy elements:
silicon 11% to 14% by wt.,
copper 5.2% to 8% by wt.,
nickel 1.5% to 4% by wt.,
iron 0.2% to 1.5% by wt.,
magnesium 0.2% to 1% by wt.,
manganese 0.2% to 1.3% by wt.,
barium up to 1%
titanium 0.05% to 0.2% by wt.,
zirconium 0.05% to 0.2% by wt.,
vanadium up to 0.2% by wt.,
phosphorus 0.004% to 0.05% by wt., and
the balance being aluminum and unavoidable impurities.

19. The engine component according to claim 7, in the form of a piston composed at least partly of the aluminum alloy.

20. The process according to claim 1, wherein the engine component is a piston for an internal combustion engine.

* * * * *